US008608492B2

(12) United States Patent
Cananzi et al.

(10) Patent No.: US 8,608,492 B2
(45) Date of Patent: Dec. 17, 2013

(54) ELECTRICAL PLUG SAFETY DEVICE WITH A SECURING MEMBER ENGAGING SIDES OF THE PINS OF A PLUG

(75) Inventors: Darren Mark Cananzi, Kinross (AU); Edward Joseph Khoury, Bateman (AU)

(73) Assignee: Darren Mark Cananzi, Kinross (AU)

( * ) Notice: Subject to any disclaimer, the term of this patent is extended or adjusted under 35 U.S.C. 154(b) by 3 days.

(21) Appl. No.: 13/510,657

(22) PCT Filed: Nov. 22, 2010

(86) PCT No.: PCT/AU2010/001567

§ 371 (c)(1),
(2), (4) Date: Jul. 2, 2012

(87) PCT Pub. No.: WO2011/060507

PCT Pub. Date: May 26, 2011

(65) Prior Publication Data

US 2012/0264314 A1 Oct. 18, 2012

(30) Foreign Application Priority Data

Nov. 23, 2009 (AU) ..... 2009905718

(51) Int. Cl.
*H01R 13/44* (2006.01)

(52) U.S. Cl.
USPC ..... 439/133

(58) Field of Classification Search
USPC ..... 439/133–136, 346–347
See application file for complete search history.

(56) References Cited

U.S. PATENT DOCUMENTS

| | | | | |
|---|---|---|---|---|
| 4,204,723 | A * | 5/1980 | Bloomingdale | 439/135 |
| 5,666,829 | A | 9/1997 | Aikens | |
| 6,220,885 | B1 * | 4/2001 | Lemberger et al. | 439/346 |
| 6,508,654 | B1 * | 1/2003 | Tatz | 439/134 |
| 6,773,277 | B2 * | 8/2004 | Issa | 439/133 |
| 7,497,705 | B2 * | 3/2009 | Larson et al. | 439/133 |

FOREIGN PATENT DOCUMENTS

| | | |
|---|---|---|
| AU | 2005205814 A1 | 3/2006 |
| EP | 0949716 A2 | 10/1999 |
| WO | WO 2008/033397 | 3/2008 |

OTHER PUBLICATIONS

"PCT/AU2010/001049 Search Report", PCTAU2010001049 NPL-1 Mar. 23, 2011 , pp. 1-3.
"PCT/AU2010/001049 Written Opinion", PCTAU2010001049 NPL-2 Mar. 23, 2011 , pp. 1-6.

* cited by examiner

*Primary Examiner* — Chandrika Prasad
(74) *Attorney, Agent, or Firm* — Strategic Patents, P.C.

(57) ABSTRACT

An electrical plug safety device (10) comprising a body (16) having apertures for receiving pins (14) of an electrical plug (12). A securing member 32 is provided within the body (16) to engage with a side of at least one of said pins (14) when the pins (14) are received in the apertures such that engagement between the securing member (32) and the side of the pin (14) restricts removal of the plug (12) from the body (16). When sufficient force is applied to the body (16) in a direction away from the plug (12), the securing member (32) is disengaged from the pin (14) and moves such that the securing member (32) will not re-engage with a pin (14) inserted into the body (16).

18 Claims, 11 Drawing Sheets

ELECTRICAL PLUG SAFETY DEVICE WITH A SECURING MEMBER ENGAGING SIDES OF THE PINS OF A PLUG

RELATED APPLICATIONS

This application is a national stage filing under U.S.C. §371 of published International Application No. PCT/AU2010/001567 filed on Nov. 22, 2010, which is incorporated herein by reference in its entirety. International Application No. PCT/AU2010/001567 was published in English as Publication No. WO 2011/060507. International Application No. PCT/AU2010/001567 claims priority to AU Patent Application 2009905718 filed Nov. 23, 2009, which is incorporated herein by reference in its entirety.

FIELD OF THE INVENTION

The present invention relates to a safety device to be used on electrical plugs. In particular it relates to a device that can be secured to the electrical plug to prevent use.

BACKGROUND TO THE INVENTION

There are many circumstances in which it is desired to prevent use of an electrical device. The device may be faulty and use of the device could be hazardous. In some industrial situations, electrical tools require regular services and checking by authorised personnel and should not be used until this process has been carried out. Also, some electrical devices are simply dangerous to operate and it is therefore desirable to secure the devices so that they cannot be operated other than by the appropriate person.

The present invention relates to an electrical plug safety device for attachment to the plug of an electrical device to prevent its use.

SUMMARY OF THE INVENTION

According to one aspect of the present invention there is provided an electrical plug safety device comprising:

a body having apertures for receiving pins of an electrical plug; and a securing member within the body to engage with a side of at least one of said pins when the pins are received in the apertures such that engagement between the securing member and the side of the pin restricts removal of the plug from the body;

wherein when sufficient force is applied to the body in a direction away from the plug, the securing member is disengaged from the pin and moves such that the securing member will not re-engage with a pin inserted into the body.

Preferably the securing member engages against adjacent surfaces of a pair of pins.

Preferably the securing member comprises a planar member located within the body having a central portion engaged by the body and ends that engage said adjacent surfaces of the pins such that the centre of the securing member is pushed towards the plug during application and the ends of the securing member drag against the inner surfaces of the pins.

In a preferred embodiment, ends of the securing member include angled portions that are angled in a direction away from the direction of travel of the body during application to aid in the ends dragging against adjacent surfaces of the pins. The securing member may be formed from a sheet of metallic material.

Preferably the securing member is pushed in a direction transversely to the direction of the pins during removal such that the securing member is pushed away from sides of the inner surfaces of the pins that are closer together and towards sides of the inner surfaces of the pins that are further away, thereby disengaging the securing member from the pins.

In a preferred embodiment, the securing member is moved during removal in a direction towards an earth pin of the plug.

In one embodiment, the body comprises a first body portion having apertures in which the pins are received and a second body portion moveable relative to the first body portion such that during removal the second body portion slides away from the first body portion to provide a visual indication that the electrical plug safety device has been used and removed.

The second body portion may be of a different colour to the first hollow tube to provide a visual indication of disengagement from the plug.

Preferably the first body portion comprises a first hollow tube and the second body portion comprises a second hollow tube slidably received within the first hollow tube.

The second body portion preferably includes an end portion secured to the second hollow tube including a recessed handle provided for pulling the body from the plug. The first and second hollow tubes may have elliptical cross sections.

Preferably there is provided a guide member within the body secured adjacent a first end thereof to the second body portion, the guide member being received within a groove in the securing member and including an outwardly tapered side such that the outwardly tapered side engages with the securing member to move the securing member in said transverse direction during removal.

In a preferred embodiment, a protrusion is provided on an inner surface of the end portion of the second body portion such that the protrusion engages with the central portion of the securing member during application to push the securing member towards the plug between the pins.

Preferably a first end of the guide member includes a pair of flexible teeth that engage within a recess provided in the protrusion.

In a preferred embodiment, a second end of the guide member is received in an opening in an end of the first body portion, the opening including internal teeth to engage with lugs on opposed sides of the guide member such that as the second end of the guide member is pulled into the opening during the removal process the lugs ride over the teeth preventing movement of the guide member in the opposite direction.

Preferably a security tag is provided secured adjacent the recessed handle preventing access to the recessed handle.

The security tag may comprise a planar member secured from a first side of the recessed handle to a second side of the recessed handle, wherein the connections of the security tag on either side of the recessed handle comprise frangible portions of material such that the security tag can be rotated away from the recessed handle by fracturing the frangible portions.

BRIEF DESCRIPTION OF THE DRAWINGS

The invention will now be described, by way of example, with reference to the following drawings in which.

DETAILED DESCRIPTION OF PREFERRED EMBODIMENTS

Figure 1:
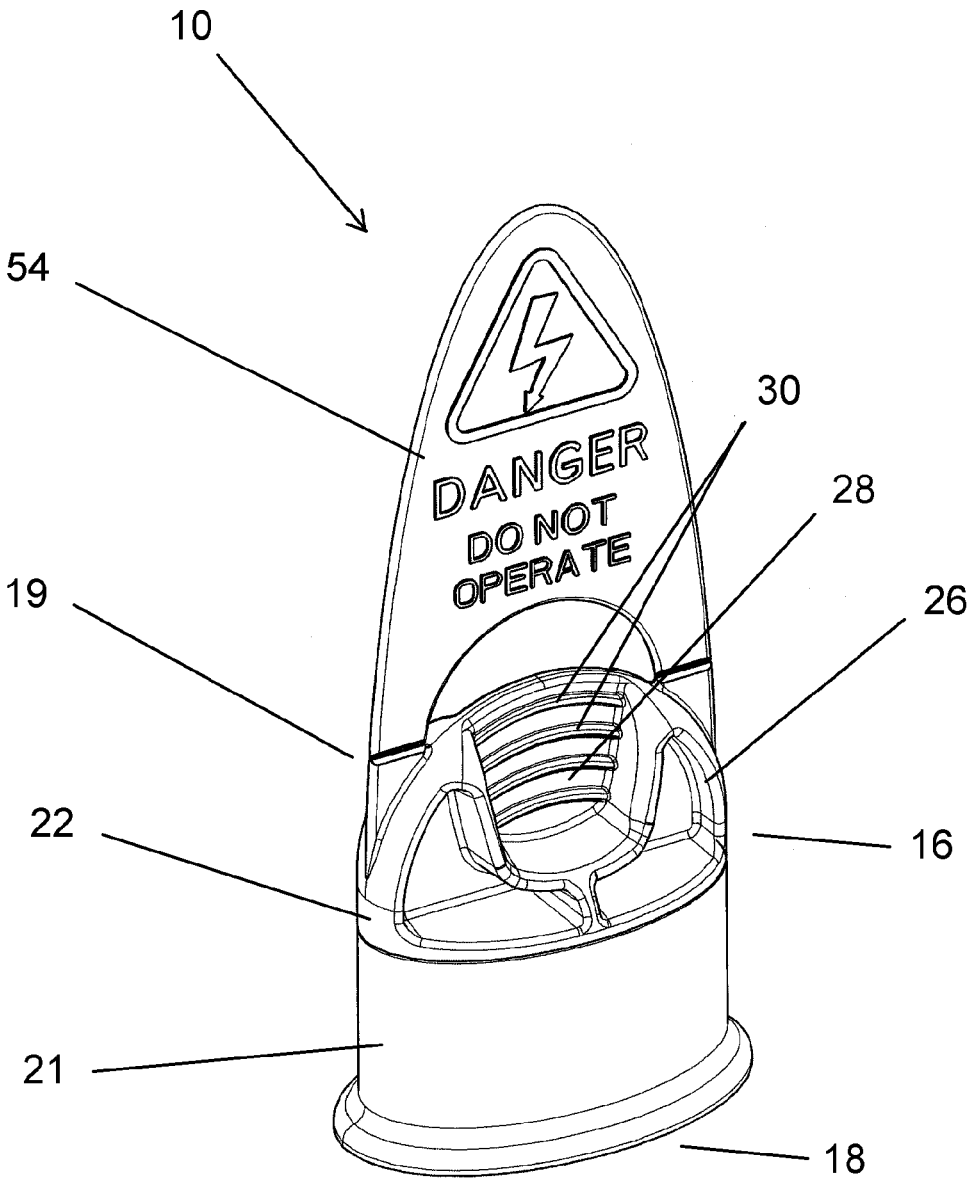
FIG. 1 is an upper perspective view of an electrical plug safety device in accordance with the present invention.
Figure 2:
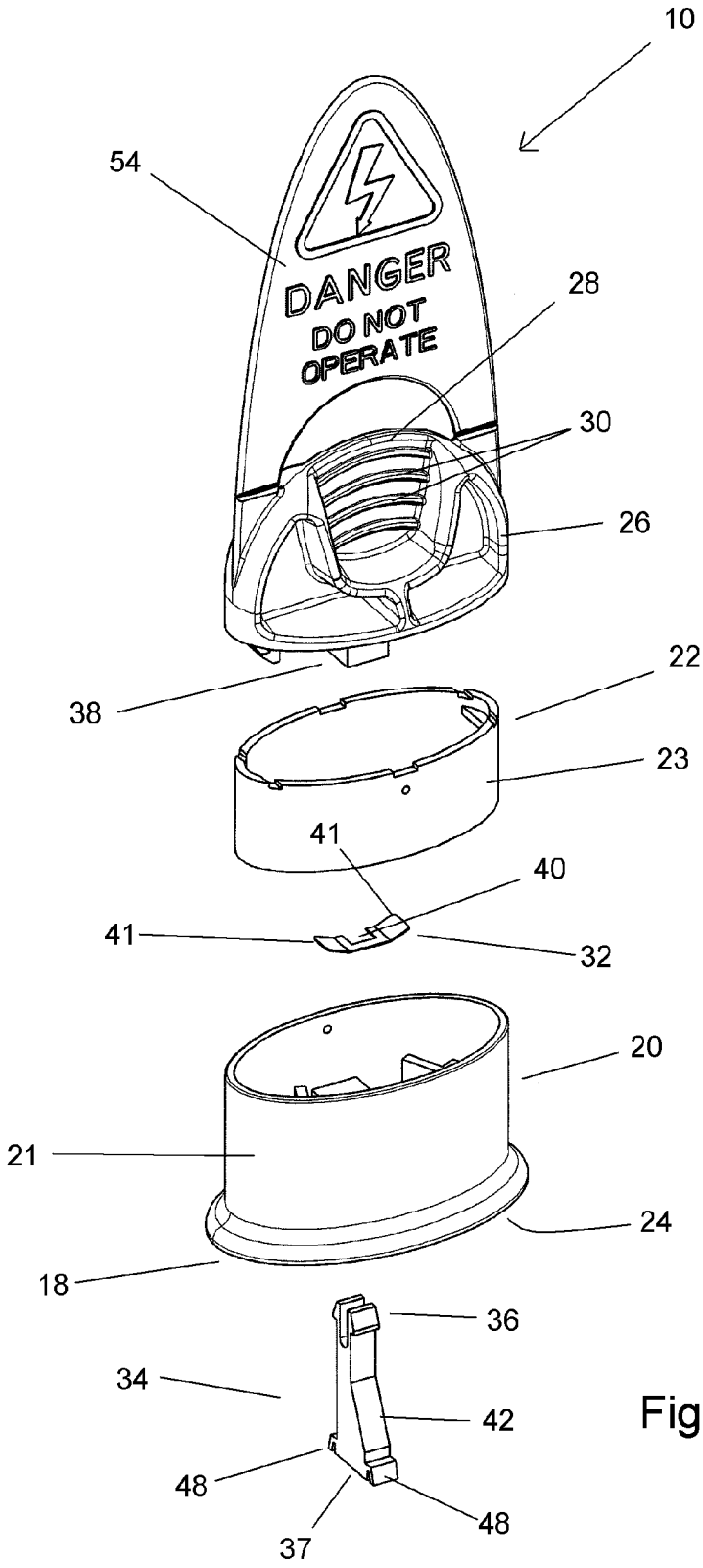
FIG. 2 is an exploded view of the electrical plug safety device of FIG. 1.
Figure 3:
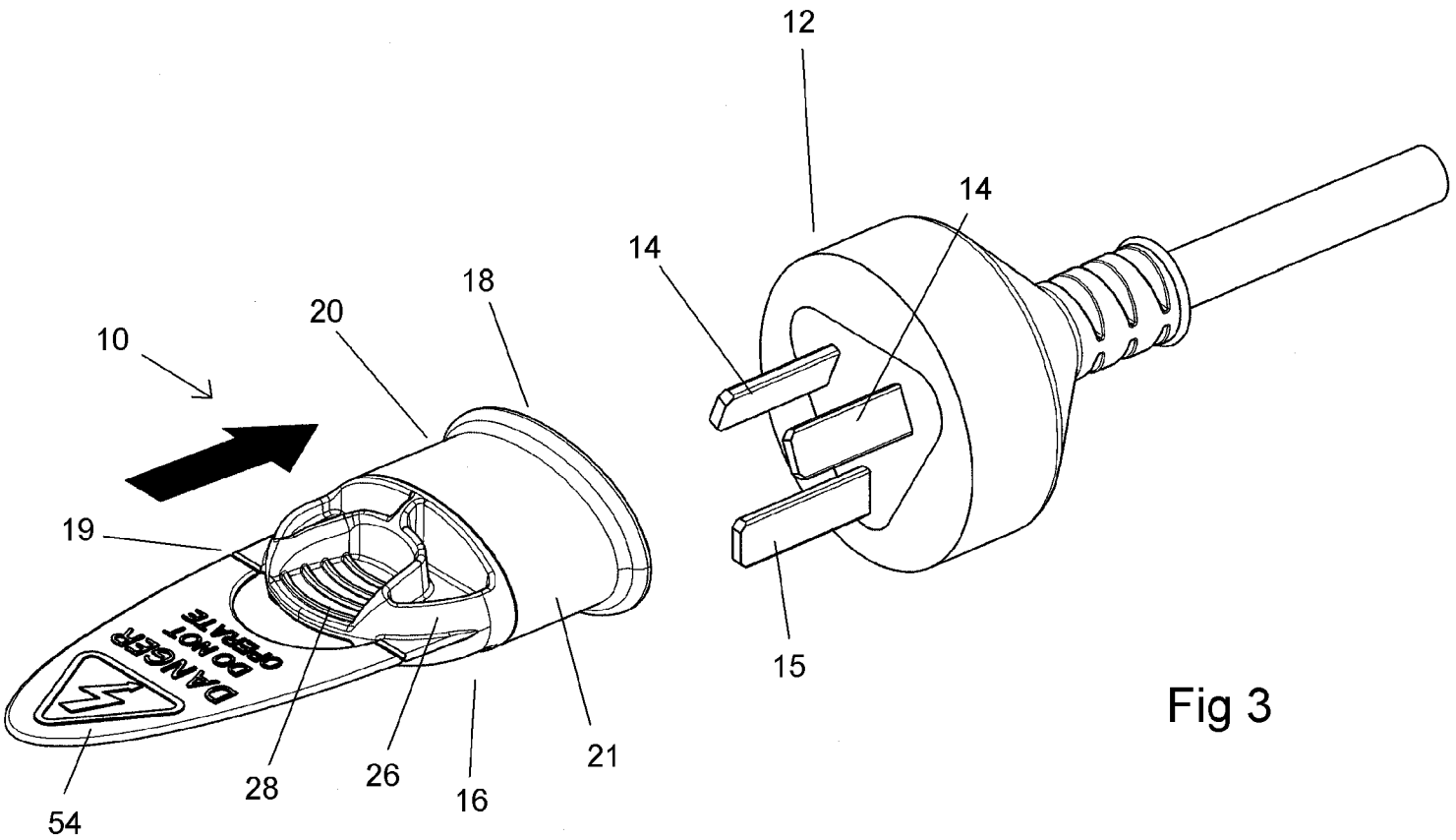
FIG. 3 is a perspective view of the electrical plug safety device being secured to the pins of an electrical plug.

Referring to the Figures, there is shown an electrical plug safety device 10 for securing an electrical plug 12. The electrical plug safety device 10 is provided to engage with the pins of the plug 12. In the embodiment shown, the electrical plug safety device 10 is arranged to engage with two pins 14, being the active and neutral pins of the plug 12.

The electrical plug safety device 10 comprises a body 16 having apertures in a first end 18 thereof for receiving the pins 14. The body 16 comprises a first body portion 20 adjacent the first end 18 thereof and a second body portion 22 adjacent a second end 19 thereof. The second body portion 22 is moveable relative to the first body portion 20. The first body portion 20 comprises a first hollow tube 21 having a planar closed end 24 at the first end 18 of the body 16. The closed end 24 of the first body portion 20 includes the apertures in which the pins 14 of the plug 12 are received. The first hollow tube 21 forming the first body portion 20 has an elliptical cross section.

The second body portion 22 comprises second hollow tube 23 also of elliptical cross section. The second hollow tube 23 is sized such that it is slidably received within the first hollow tube 21 of the first body portion 20. The second body portion 22 also includes an end portion 26 secured to the second hollow tube 23 on a side remote from the first body portion 20. The end portion 26 includes a recessed handle 28 for gripping by a suitable tool, such as a pair of pliers. The recessed handle 28 comprises a planar section having a plurality of ribs 30 thereon for grip. The recessed handle 28 is arranged such that the tool can engage on the recessed handle 28 to provide a pulling force such that the end portion 26 and the second hollow tube 23 are pulled away from the first body portion 20 of the electrical plug safety device 10.

The electrical plug safety device 10 includes also a securing member 32 and a guide member 34 within the body 16. The guide member 34 is located within the body 16 and includes a first end 36 securable to the end portion 26 of the second body portion 22. The first end 36 includes a pair of flexible teeth that engage within a recess in a protrusion 38 on an inner surface of the end portion 26. The securing member 32 comprises a planar member located within the body having a groove 40 therein such that the guide member 34 is received in the groove 40.

Figure 4B:
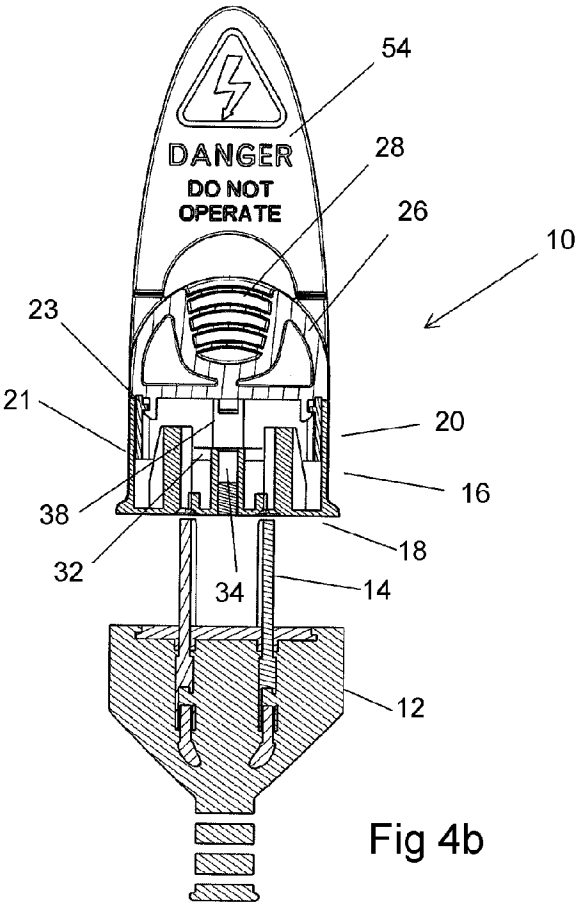
FIG. 4*b* is a front cross sectional view of the electrical plug safety device of FIG. 1 prior to engagement with the pins of an electrical plug.
Figure 4A:
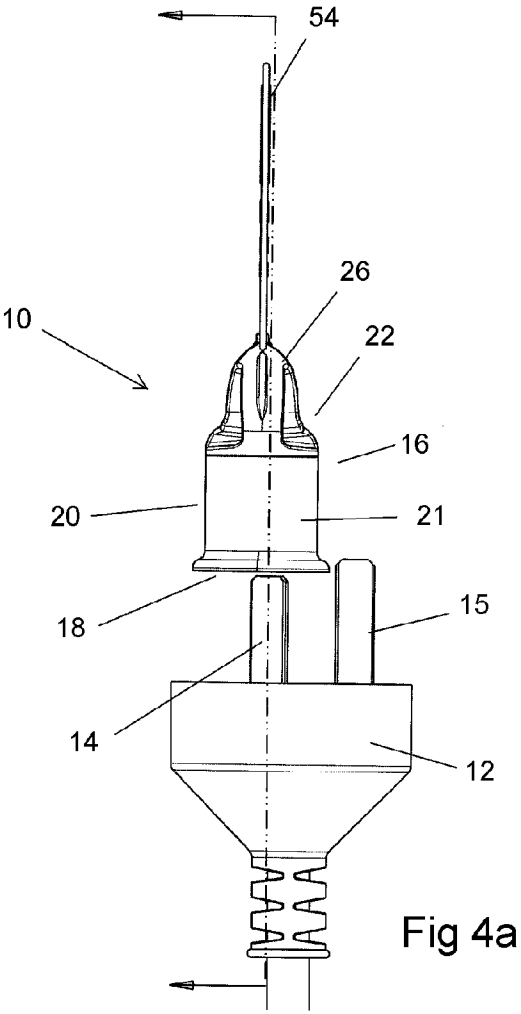
FIG. 4*a* is a side view of the electrical plug safety device of FIG. 1 prior to engagement with the pins of an electrical plug.
Figure 5B:
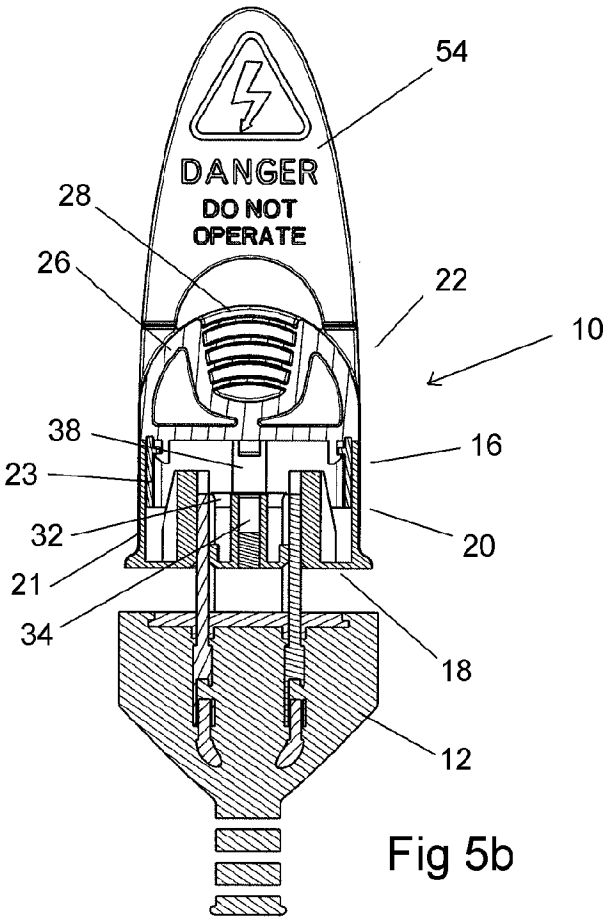
FIG. 5*b* is a front cross sectional view of the electrical plug safety device of FIG. 1 partially engaged with the pins of an electrical plug.
Figure 5A:
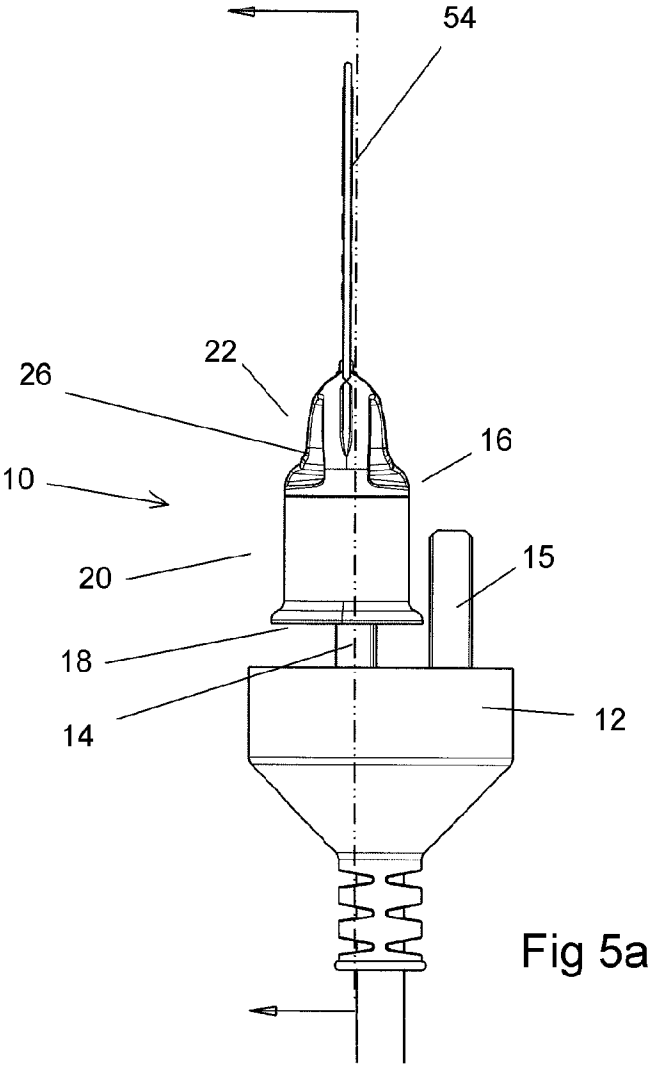
FIG. 5*a* is a side view of the electrical plug safety device of FIG. 1 partially engaged with the pins of an electrical plug.
Figure 6B:
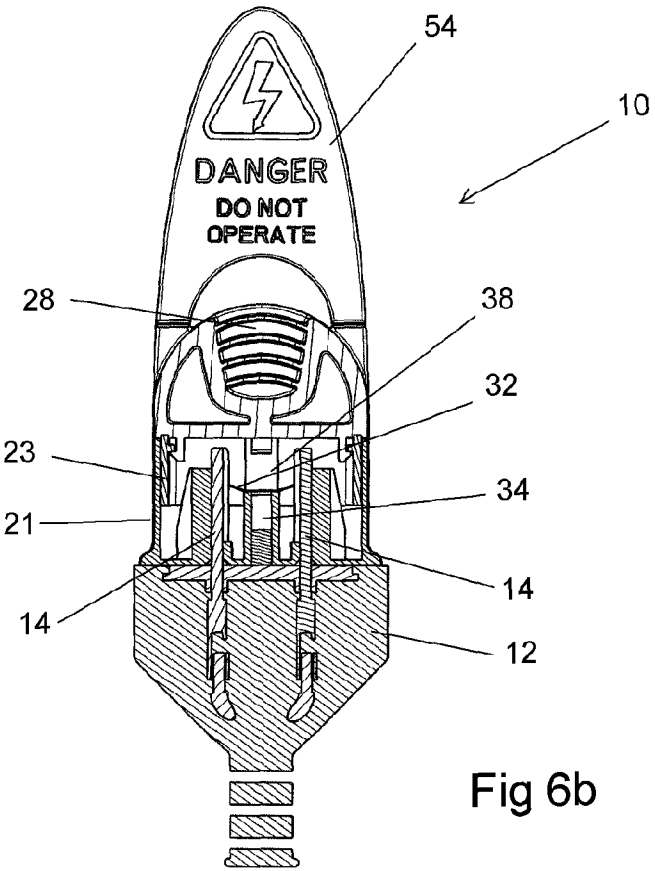
FIG. 6*b* is a front cross sectional view of the electrical plug safety device of FIG. 1 engaged with the pins of an electrical plug.
Figure 6A:
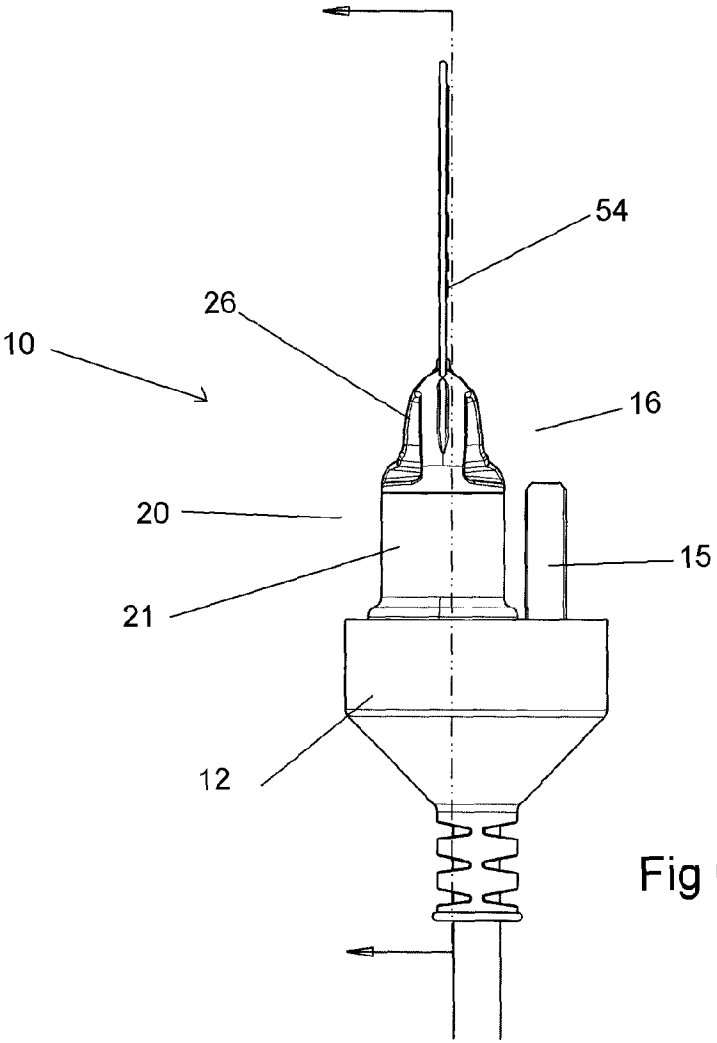
FIG. 6*a* is a side view of the electrical plug safety device of FIG. 1 engaged with the pins of an electrical plug.
Figure 7:
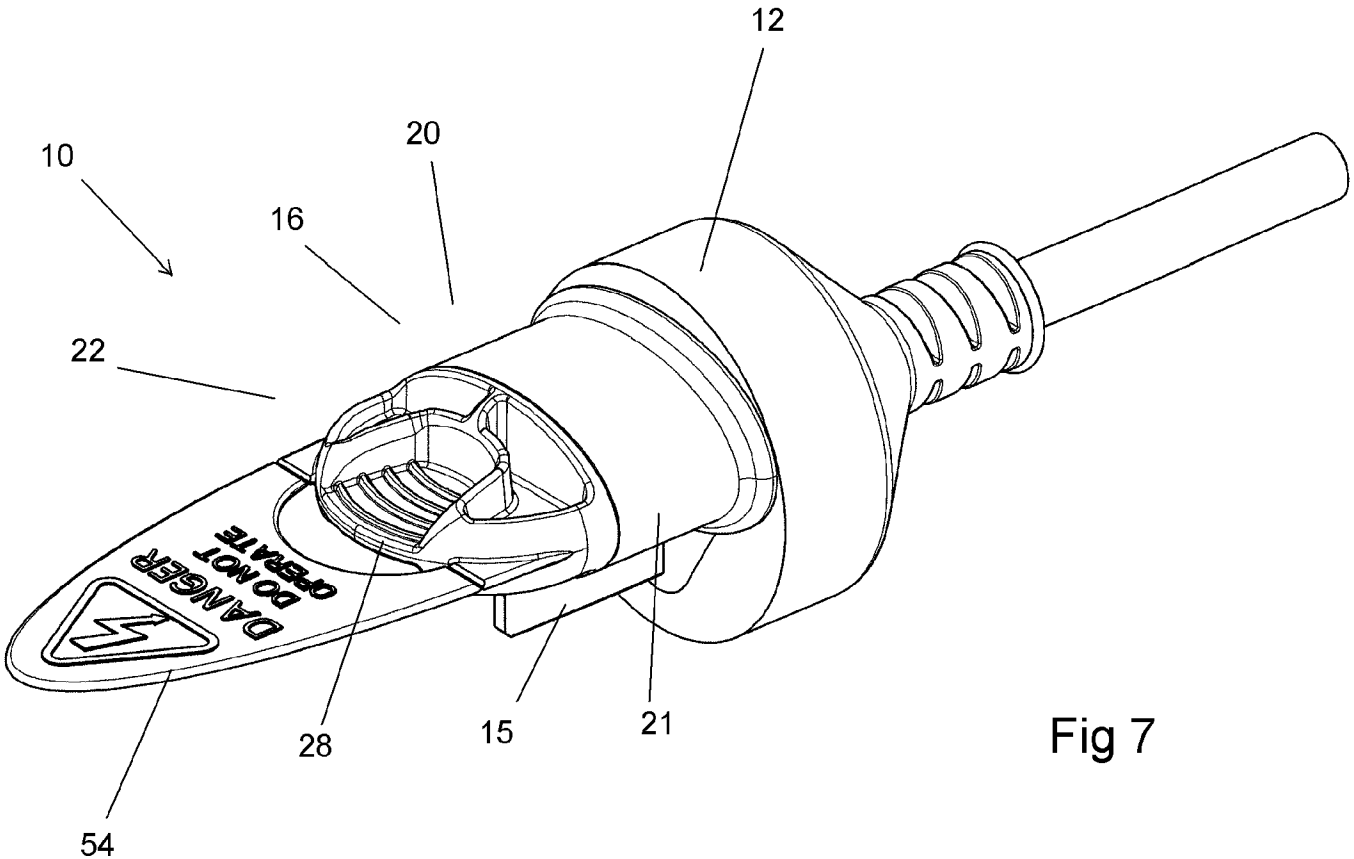
FIG. 7 is a perspective view of the electrical plug safety device secured to the pins of an electrical plug.

As can be seen in FIGS. 4 to 6, the electrical plug safety device 10 is ready for use when in a position in which the second hollow tube 23 is fully received in the first hollow tube 21 and the end portion 26 is located adjacent the first hollow tube 21. In this position, the securing member 32 is within the body 16 such that the guide member 34 is located within the groove 40. The securing member 32 is oriented in a plane perpendicular to the direction of the pins 14 and rests adjacent the protrusion 38 on the inner surface of the end portion 26. The securing member 32 is of a length such that ends thereof engage with each of the pins 14.

During engagement, the electrical plug safety device 10 is pushed towards the plug 12 such that the pins 14 are received in the apertures of the body 16. During this process, the end portion 26 pushes directly against the first body portion 20. The securing member 32 is pushed towards the plug 12 by the protrusion 38 and ends of the securing member 32 engage with adjacent inner surfaces of the pins 14. The securing member 32 is flexible such that the centre of the securing member 32 adjacent the groove 40 is pushed downwardly by the protrusion 38 towards the plug 12 while the ends of the securing member 32 drag against the inner surfaces of the pins 14 (as can be seen in FIG. 6*b*). The ends of the securing member include angled portions 41 that are angled in a direction away from the direction of travel of the body 16 during application to aid in the ends dragging against adjacent surfaces of the pins 14.

The securing member 40 therefore deforms as it slides along the pins 14 with the central portion moving forwardly of the ends. This deformation restricts movement of the securing member in the opposite direction. The securing member 32 can therefore be moved down the pins 14 towards the plug 12 but movement back up the pins 14 is restricted. The securing member 32 is expected to be made from a sheet of metallic material.

Figure 10C:
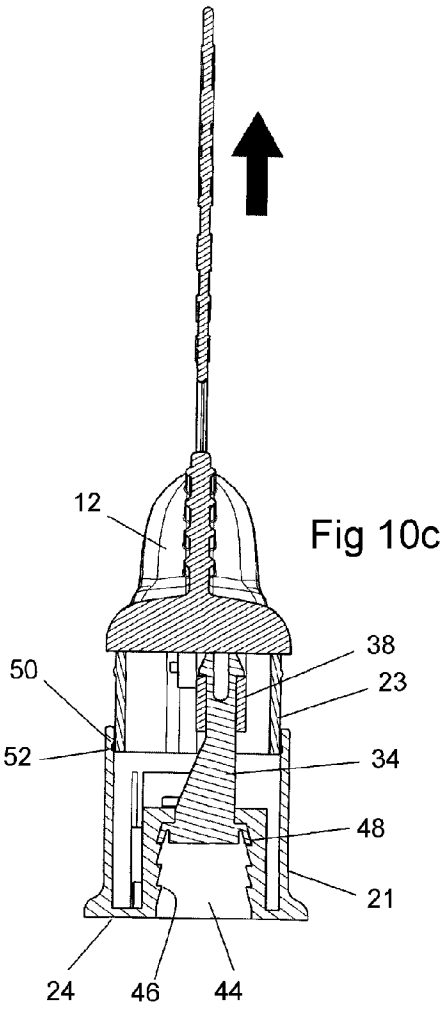
FIG. 10*c* is a side cross sectional view of the electrical plug safety device of FIG. 1 in a final stage of disengagement.
Figure 10B:
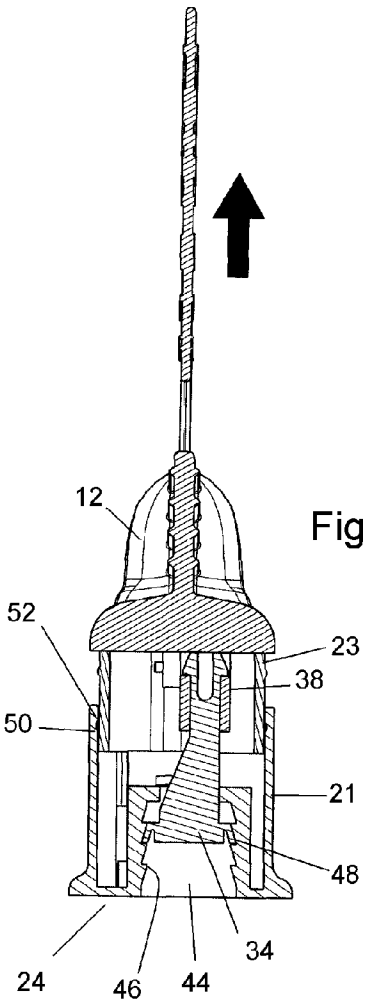
FIG. 10*b* is a side cross sectional view of the electrical plug safety device of FIG. 1 in a second stage of disengagement.
Figure 10A:
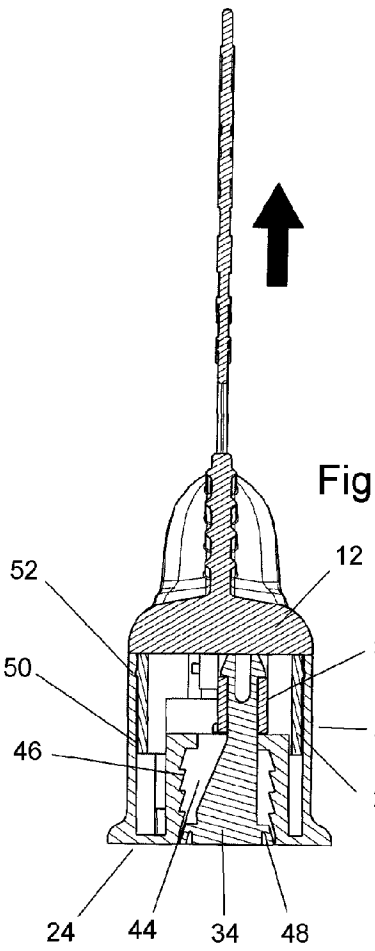
FIG. 10*a* is a side cross sectional view of the electrical plug safety device of FIG. 1 in a first stage of disengagement.
Figure 11:
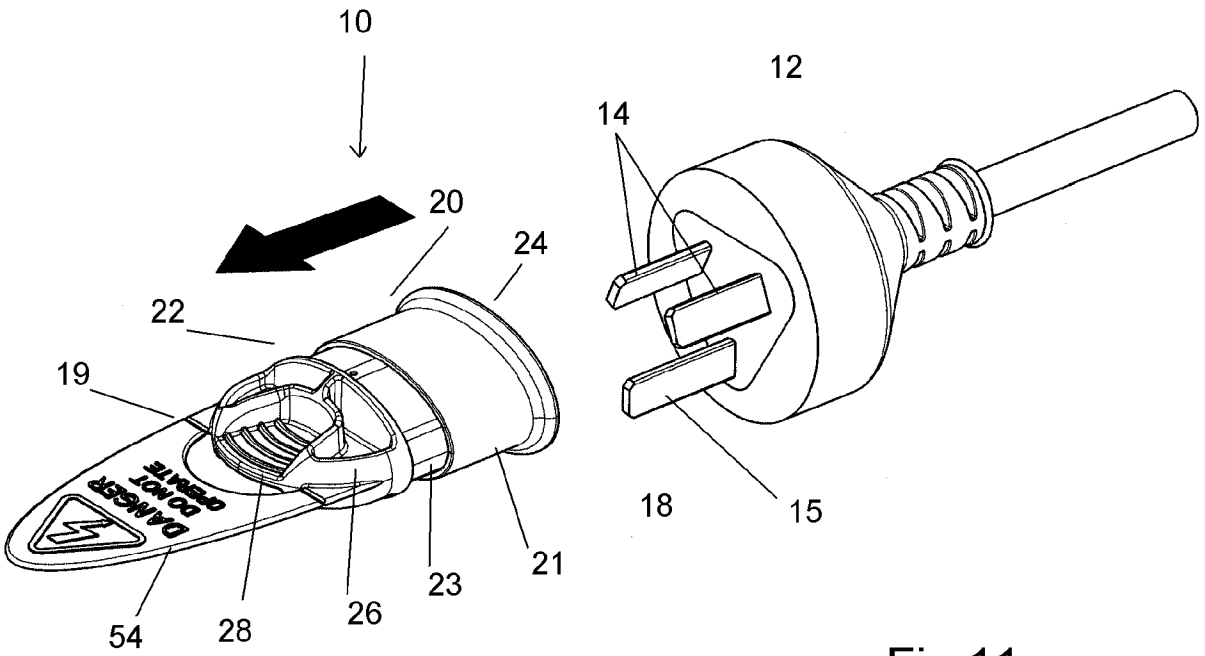
FIG. 11 is a perspective view of the electrical plug safety device of FIG. 1 disengaged from the electrical plug.

A second end 37 of the guide member 34 includes an outwardly tapered side 42, being the side located adjacent the inner surface of the groove 40 on the securing member 32. The second end 37 of the guide member 34 is received in an opening 44 in the planar closed end 24 of the first body portion 20 (as shown in FIG. 10). When the second hollow tube 23 of the second body portion 22 is located fully within the first body portion 20, the second end 37 of the guide member 34 is located generally level with the planar closed end 24. The opening 44 includes internal teeth 46 on opposed side thereof. The internal teeth 46 engage with lugs 48 on opposed sides of the guide member 34 at the second end 37 thereof. The lugs 48 engage with the teeth 46 such that as the second end 37 of the guide member 34 is pulled into the opening 44 (as occurs during the removal process) the lugs 48 ride over the teeth 46 preventing movement of the guide member 34 in the opposite direction.

Figures 9A, 9B, 9C, 9D:
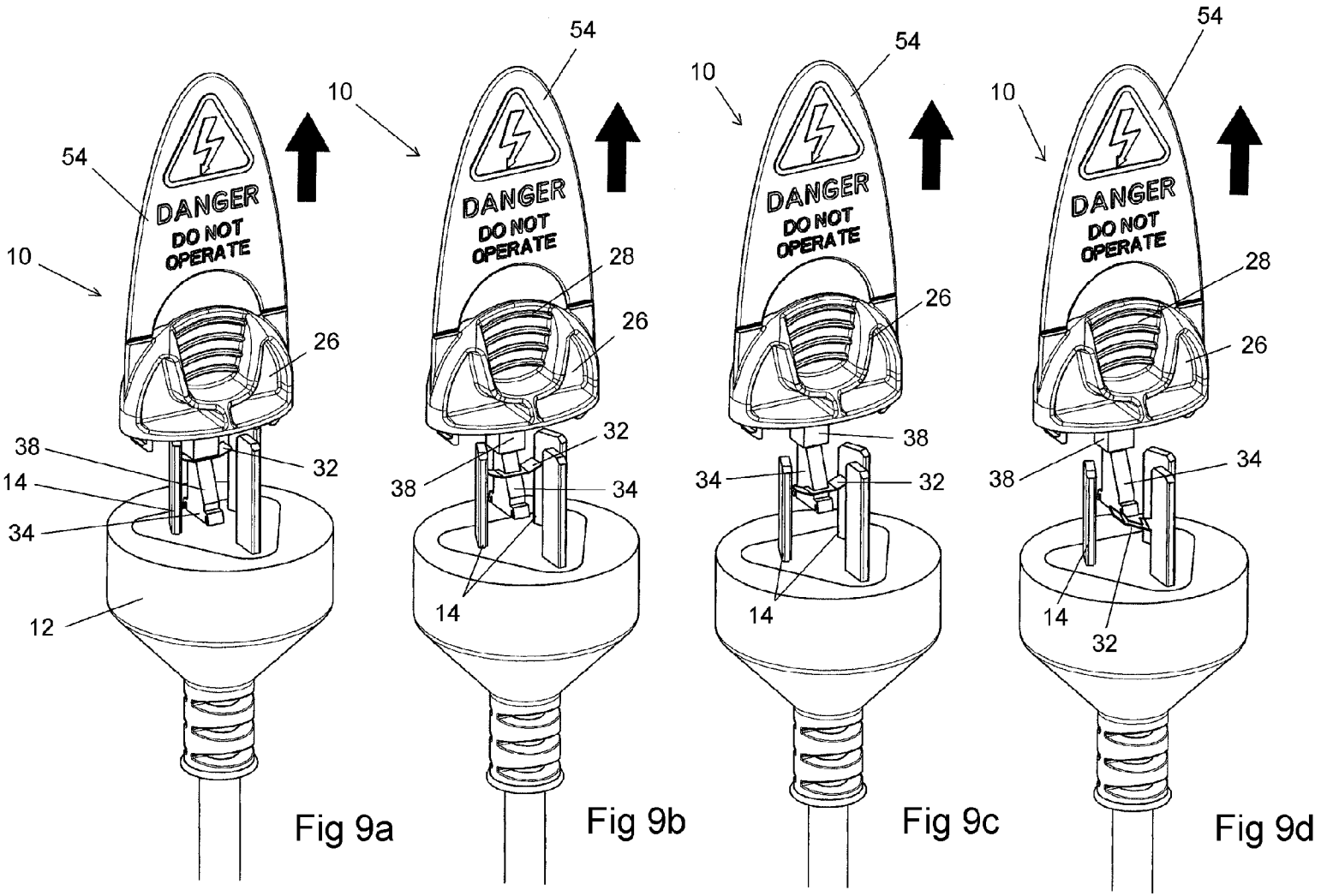
FIG. 9*a* is a perspective view of the electrical plug safety device of FIG. 1 with a portion of the body removed for clarity in a first stage of disengagement.
FIG. 9*b* is a perspective view of the electrical plug safety device of FIG. 1 with a portion of the body removed for clarity in a second stage of disengagement.
FIG. 9*c* is a perspective view of the electrical plug safety device of FIG. 1 with a portion of the body removed for clarity in a third stage of disengagement.
FIG. 9*d* is a perspective view of the electrical plug safety device of FIG. 1 with a portion of the body removed for clarity in a final stage of disengagement.

FIGS. 9 and 10 show the removal process of the electrical plug safety device 10 from the plug 12. The engagement of the securing member 32 is such that a significant amount of force is required to disengage the electrical plug safety device 10 from the plug 12. It is envisaged that a pair of pliers would be used to grip the recessed handle 28 to provide this force. As force is applied to the second body portion 22 pulling it away from the first body portion 20, the second hollow tube 23 slides outwardly from within the first hollow tube 21. The guide member 34 is also drawn away from the plug 12 and pulled into the opening 44.

The tapered side 42 of the guide member 34 engages with the securing member 32 such that the securing member 32 is pushed in a direction transversely to the direction of the pins 14. In particular, as inner faces of the active and neutral pins 14 are angled, the securing member 32 is pushed in a direction away from the sides of the inner surfaces of the pins 14 that are closer together and towards the sides of the inner surfaces of the pins 14 that are further away. In the case shown, that is in a direction towards the earth pin 15. Pushing the securing member 32 in this direction causes it to both disengage from the pins 14 and to then disengage and fall away from the guide member 34. Once this has occurred, the electrical plug safety device 10 cannot be re-used by putting it back on the plug 12, as the securing member 32 will no longer engage with the pins 14.

Once the securing member 32 is disengaged, the electrical plug safety device 10 can be fully removed. When the second hollow tube 23 has been fully extended from the first hollow tube 21, a rib 50 adjacent the edge of the second hollow tube 23 engages in a channel 52 adjacent the edge of the first hollow tube 21 so that the first body portion 20 can also be pulled off the plug 12.

The second hollow tube 23 of the second body portion 22 provides an indication that the electrical plug safety device 10 has been removed and is no longer available for re-use. Therefore if a person removes the electrical plug safety device 10 from the plug 12 to use the electrical device, they will not be able to simply reattach the electrical plug safety device 10. It is expected that the second hollow tube 23 will be of a bright colour being different to the rest of the electrical plug safety device 10 so a clear visual indication is provided if the electrical plug safety device 10 has been disengaged.

Figure 8:
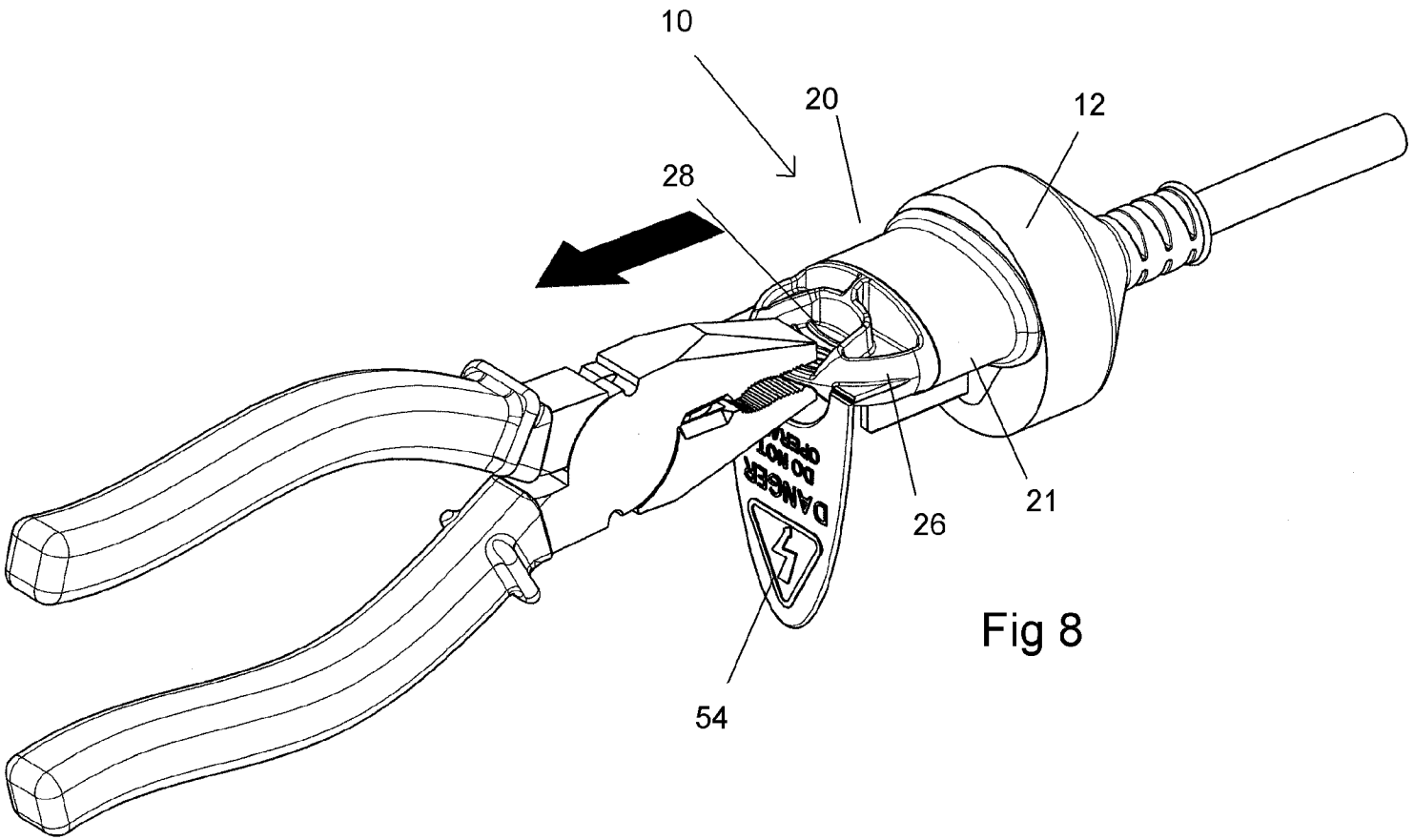
FIG. 8 is a perspective view of the electrical plug safety device being removed with a pair of pliers.

Further, a security tag 54 is provided on the end portion 26 of the electrical plug safety device 10. The security tag 54 comprises a planar member secured parallel to the recessed handle 28 from a first side thereof to a second side thereof. The security tag 54 thereby prevents access to the recessed handle 28. The connections of the security tag 54 on either side of the recessed handle 28 comprise frangible portions of material such that the security tag can be rotated away from the recessed handle 28 by fracturing the frangible portions (as shown in FIG. 8). This also provides a further indication that the electrical plug safety device 10 has been used.

It will be readily apparent to persons skilled in the relevant arts that various modifications and improvements may be made to the foregoing embodiments, in addition to those already described, without departing from the basic inventive concepts of the present invention.

The invention claimed is:

1. An electrical plug safety device comprising:

a body having apertures for receiving pins of an electrical plug; and a securing member located within the body such that a first end is adjacent a first of said apertures and a second end is adjacent a second of said apertures such that the first and second ends engage against adjacent surfaces of the pins when the pins are received in the apertures such that engagement between the securing member and the side of the pin restricts removal of the plug from the body;

wherein when sufficient force is applied to the body in a direction away from the plug, the securing member is disengaged from the pin and moves such that the securing member will not re-engage with a pin inserted into the body.

2. An electrical plug safety device in accordance with claim 1, wherein the securing member comprises a planar member located within the body having a central portion engaged by the body such that the centre of the securing member is pushed towards the plug as the pins are received in the body and the ends of the securing member drag against the adjacent surfaces of the pins.

3. An electrical plug safety device in accordance with claim 2, wherein ends of the securing member include angled portions that are angled in a direction away from the direction of travel of the body as the pins are received in the body to aid in the ends dragging against adjacent surfaces of the pins.

4. An electrical plug safety device in accordance with claim 3, wherein the securing member is formed from a sheet of metallic material.

5. An electrical plug safety device in accordance with claim 4, wherein the securing member is pushed in a direction transversely to the direction of the pins during removal such that the securing member is pushed away from sides of the adjacent surfaces of the pins that are closer together and towards sides of the adjacent surfaces of the pins that are further away, thereby disengaging the securing member from the pins.

6. An electrical plug safety device in accordance with claim 5, wherein the securing member is moved during removal in a direction towards an earth pin of the plug.

7. An electrical plug safety device in accordance with claim 6, wherein the body comprises a first body portion having apertures in which the pins are received and a second body portion moveable relative to the first body portion such that during removal the second body portion slides away from the first body portion to provide a visual indication that the electrical plug safety device has been used and removed.

8. An electrical plug safety device in accordance with claim 7, wherein the second body portion is of a different colour to the first hollow tube body portion to provide a visual indication of disengagement from the plug.

9. An electrical plug safety device in accordance with claim 8, wherein the first body portion comprises a first hollow tube and the second body portion comprises a second hollow tube slidably received within the first hollow tube.

10. An electrical plug safety device in accordance with claim 9, wherein the second body portion includes an end portion secured to the second hollow tube including a recessed handle provided for pulling the body from the plug.

11. An electrical plug safety device in accordance with claim 10, wherein the first and second hollow tubes have elliptical cross sections.

12. An electrical plug safety device in accordance with claim 11, wherein there is provided a guide member within the body secured adjacent a first end thereof to the second body portion, the guide member being received within a groove in the securing member and including an outwardly tapered side such that the outwardly tapered side engages with the securing member to move the securing member in said transverse direction during removal.

13. An electrical plug safety device in accordance with claim 12, wherein a protrusion is provided on an inner surface of the end portion of the second body portion such that the protrusion engages with the central portion of the securing member during application to push the securing member towards the plug between the pins.

14. An electrical plug safety device in accordance with claim 13, wherein a first end of the guide member includes a pair of flexible teeth that engage within a recess provided in the protrusion.

15. An electrical plug safety device in accordance with claim 13, wherein a second end of the guide member is received in an opening in an end of the first body portion, the opening including internal teeth to engage with lugs on opposed sides of the guide member such that as the second end of the guide member is pulled into the opening during the removal process the lugs ride over the teeth preventing movement of the guide member in the opposite direction.

16. An electrical plug safety device in accordance with claim 15, wherein a security tag is provided secured adjacent the recessed handle preventing access to the recessed handle.

17. An electrical plug safety device in accordance claim 16, wherein the security tag comprises a planar member secured from a first side of the recessed handle to a second side of the recessed handle and wherein the connections of the security tag on either side of the recessed handle comprise frangible portions of material such that the security tag can be rotated away from the recessed handle by fracturing the frangible portions.

18. An electrical plug safety device comprising:

a body having apertures for receiving pins of an electrical plug;

a securing member within the body to engage with a side of at least one of said pins when the pins are received in the apertures such that engagement between the securing member and the side of the pin restricts removal of the plug from the body; and a member within the body having an outwardly tapered side that engages with the securing member when the body is moved in a direction away from the plug to move the securing member in direction transversely to the direction of the pins such that the securing member is disengaged from the pins.

* * * * *

UNITED STATES PATENT AND TRADEMARK OFFICE

CERTIFICATE OF CORRECTION

PATENT NO. : 8,608,492 B2
APPLICATION NO. : 13/510657
DATED : December 17, 2013
INVENTOR(S) : Darren Mark Cananzi and Edward Joseph Khoury It is certified that error appears in the above-identified patent and that said Letters Patent is hereby corrected as shown below:

In the Claims

Claim 8, Column 6, Line 52, "the first hollow tube body portion to provide a visual indication" should read -- the first body portion to provide a visual indication --

Signed and Sealed this
Fourth Day of March, 2014

Michelle K. Lee

Michelle K. Lee
*Deputy Director of the United States Patent and Trademark Office*